United States Patent [19]

McDonald

[11] 4,158,387

[45] Jun. 19, 1979

[54] BLOWDOWN APPARATUS

[75] Inventor: Bertrand N. McDonald, Clearwater, Fla.

[73] Assignee: The Babcock & Wilcox Company, New York, N.Y.

[21] Appl. No.: 899,437

[22] Filed: Apr. 24, 1978

[51] Int. Cl.[2] ..... F28F 19/00; F22B 37/54

[52] U.S. Cl. ..... 165/71; 122/381; 165/95; 165/119; 165/134 R

[58] Field of Search ..... 122/381, 382, 383; 165/71, 95, 119, 134, 160, 161

[56] References Cited

U.S. PATENT DOCUMENTS

| | | | |
|---|---|---|---|
| 947,955 | 2/1910 | Zetka | 122/381 |
| 3,521,706 | 7/1970 | Schaefer et al. | 165/95 |
| 3,915,122 | 10/1975 | Schröder | 122/382 |
| 3,916,844 | 11/1975 | Cassell | 122/381 |
| 3,942,481 | 3/1976 | Bennett | 122/382 |

FOREIGN PATENT DOCUMENTS

| | | | |
|---|---|---|---|
| 589016 | 11/1933 | Fed. Rep. of Germany | 122/381 |

*Primary Examiner*—Sheldon J. Richter

*Attorney, Agent, or Firm*—Joseph M. Maguire; Edward A. Steen

[57] ABSTRACT

A blowdown apparatus for effectuating the removal of contaminants entrained within the boiler water of a vapor generator. The apparatus comprising a perforated blowdown pipe vertically oriented within the generator. In addition, a blowdown and drain connection is provided near the lower end of the pipe so that contaminant bearing blowdown fluid may be expelled from the generator.

6 Claims, 2 Drawing Figures

BLOWDOWN APPARATUS

BACKGROUND OF THE INVENTION

1. Field of the Invention

This invention relates to blowdown apparatus in general and more specifically to a blowdown apparatus for use in a once through steam generator.

2. Description of the Prior Art

The practice of blowing down boiler water in a recirculating steam generator to effectuate the removal of solid contaminants entrained therein is well known.

Due to the nature of recirculating steam generators, solids introduced into the generator by entering feedwater tend to concentrate within the recirculating boiler water rather than exiting with the generated steam. This undesirable state of affairs occurs, in part, due to the presence of a generally fixed steam-water inferface located within the generator. The solubility ratio between the steam and water phases at the interface results in essentially all of the soluble feedwater solids being retained in the water phase. Although maximum solids concentration will occur at the interface, a significant quantity of entrained solids will be dispersed throughout the boiler water as well. Ultimately, their continuing presence within the water will simultaneously reduce the heat transfer efficiency of the generator, promote debilitating corrosion within the steam generator and increase the carryover of solid contaminants entrained within the exit steam.

The problems previously discussed are further compounded by the fact that fresh feedwater entering the generator is constantly introducing small amounts of contaminants to the boiler water which is in addition to the contaminants already present. Left unchecked, contaminant buildup will occcur at a rapid rate.

To alleviate this problem, a portion of the boiler water is removed or "blown down" either at specific time intervals or continuously. Since the solids' concentration in the boiler is significantly greater than that of the feedwater entering the generator, the blowdown flow need only be a fraction of the feedwater flow to maintain contaminant levels within acceptable levels.

In contrast to a recirculating steam generator, a once through steam generator (OTSG) does not experience contaminant buildup at any one fixed location. This occurs because the fixed steam-water interface, always present in a recirculating steam generator, is absent when the OTSG operates at high load levels. Instead, the entrained contaminants are transferred to the exiting steam at essentially the same rates as they are introduced into the generator. As a consequence, blowdown is unnecessary at high loads. Unfortunately, when a OTSG is operated at low power levels, a steam-water interface will develop within the generator. However, in contrast to a recirculating steam generator, the position of the steam-water interface in a OTSG will vary as a function of the load impressed upon the generator. As a consequence, the previously discussed problems engendered by the steam-water interface occurring within the recirculating steam generator will manifest themselves in the OTSG as well, even though the water level may vary. Therefore, it is desirable to provide an OTSG with a universal blowdown apparatus which will eliminate contaminant buildup regardless of the level of the steam-water interface.

SUMMARY OF THE INVENTION

A once through steam generator is provided with a vertically oriented perforated blowdown pipe positioned within its tube bank chamber. A blowdown and drain connection is provided adjacent to the bottom end of the blowdown pipe to allow for the expulsion of the blowdown fluid to the exterior of the generator. This orientation recognizes the fact that the steamwater interface located within an OTSG will vary as a function of load. As a consequence, universal blowdown may be effectuated at any load or water level.

DESCRIPTION OF THE PREFERRED EMBODIMENTS OF THE INVENTION

Figure 1:
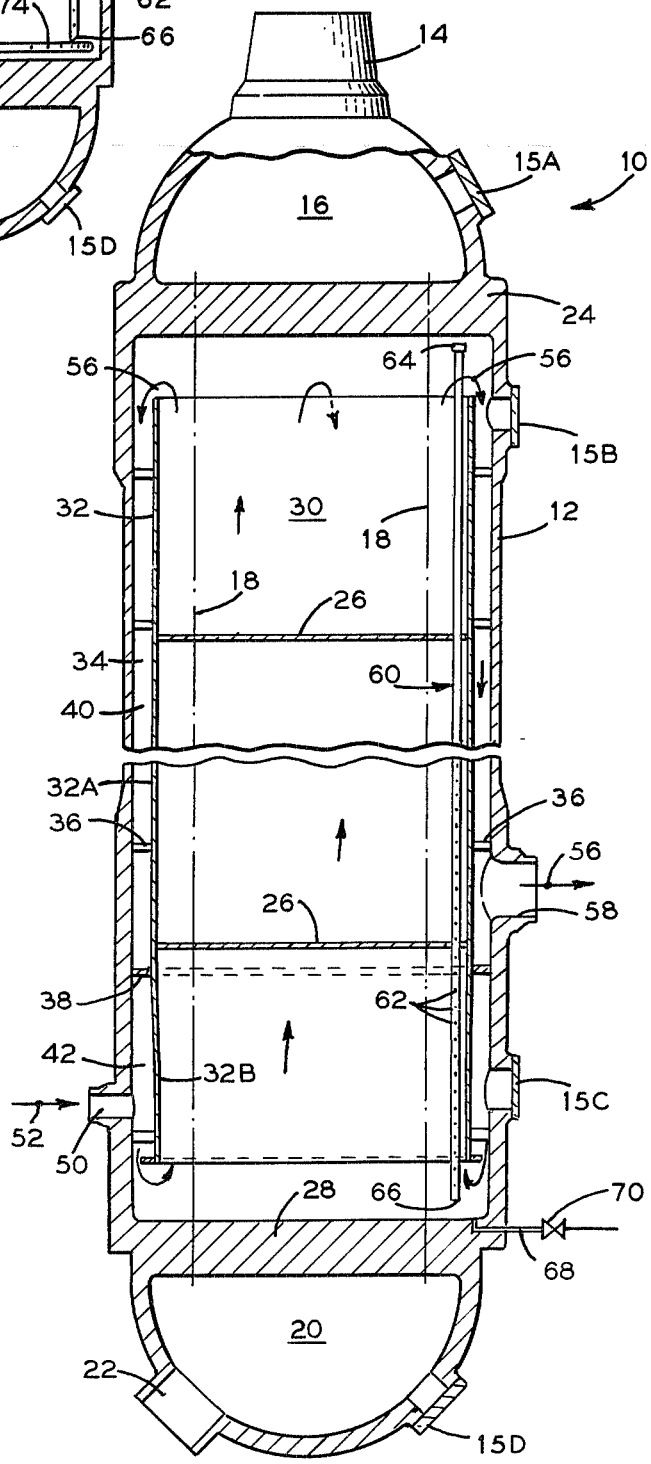
FIG. 1 is an elevation cross sectional view of a steam generator embodying the invention.

FIG. 1 shows a once through steam generator (OTSG) 10 employing shell side boiling and having an upright pressure vessel 12. Heated primary coolant enters the vessel 12 through inlet nozzle 14, flows through inlet chamber 16, then through heat exchange tubes 18, and then through outlet chamber 20 where it ultimately exits from the vessel 12 through outlet nozzle 22. The tubes 18 are supported by upper tube sheet 24, tube support plates 26 (only two are depicted) and lower tube sheet 28.

Tube bank chamber 30 is circumscribed by a cylindrical shroud 32 consisting of upper shroud 32A and lower shroud 32B. The shroud 32 cooperates with the pressure vessel 12 to define a fluid flow passage 34 therebetween. Alignment pins 36 maintain the shroud 32 in its proper orientation. Manways 15A, 15B, 15C and 15D effectuate entry into the generator 10. A partition ring 38 is disposed within the fluid flow passage 34 to define an upper fluid compartment 40 and a lower fluid compartment 42.

Feedwater enters the lower fluid compartment 42 through feedwater inlet nozzle 50 as indicated by first directional arrow 52. The feedwater then flows downward through the lower fluid compartment 42 wherein it enters the tube chamber 30 directly above the lower tube sheet 28. The water is vaporized as it passes in indirect heat exchange up and around the tubes 18 located within the tube bank chamber 30. The steam exits by passing down through the upper fluid outlet compartment 40 and out through steam outlet nozzle 58. The path taken by the steam is indicated by second directional arrows 56.

A blowdown pipe 60, equipped with a plurality of perforations 62, is vertically positioned within the tube bank chamber 30 in close proximity to the shroud 32. It should be noted that upper pipe end 64 of the pipe 60 is sealed whereas lower pipe end 66 is open ended. Furthermore, the upper pipe end 64 should be positioned in close proximity to the upper tube sheet 24 whereas the lower pipe end 66 should be positioned in close proximity to the lower tube sheet 28. Blowdown and drain connection 68, closely positioned but not connected to the lower pipe end 66 and located within the lower tube sheet 28, serves as a conduit to the exterior of the vessel 12 for the expelled blowdown fluid. Valve 70 is employed to control the flow of the blowdown fluid.

Figure 2:
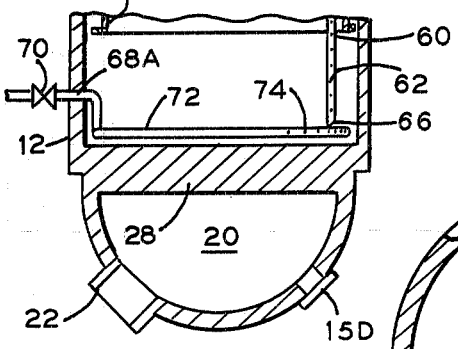
FIG. 2 is an alternate embodiment of the invention.

FIG. 2 is an alternate embodiment of the blowdown system. In this version, blowdown ring 72, having perforations 74, is disposed immediately above the lower tube sheet 28. The blowdown ring 72 is connected to blowdown and drain connection 68A shown piercing the wall of vessel 12. Note that the perforations 74 are located about the lower pipe end 66 only. As before, the blowdown fluid flow is controlled by the valve 70. It should be further recognized that although the blowdown pipe 60 and the blowdown ring 72 are in close proximity, they are not connected to one another.

The invention and the manner of applying it may, perhaps, be better understood by a brief discussion of the principles underlying the invention.

The disclosed invention successfully employs the naturally occurring thermal syphon effect present in boiling fluids to great advantage. Briefly, this effect is responsible for the recirculating flow normally present within the body of a heated fluid. The circulating flow is induced primarily by the difference in density occurring between the upwardly flowing two phase fluid in the active boiling zones of the generator and the essentially steam bubble-free peripheral areas of the generator where boiling is either absent or is occurring at a reduced rate. This difference in density results in a flow coupling effect tending to promote downward flow of the fluid in the zones of reduced boiling activity while simultaneously promoting upward flow in regions experiencing active boiling.

In the case of the OTSG shown (assuming a low water level engendered by low load conditions) boiling water will tend to flow upward to the steam-water interface wherein the essentially water-free steam entrained therein will continue to first flow upward through the tube bank chamber 30 and then downward through the fluid flow passage 34 for eventual egress from the generator 10 as shown by second directional arrows 56. The water phase at this interface, as previously explained, will retain essentially all of the soluble feedwater solids. The thermal syphon effect will cause this surface water, containing the concentrated soluble solids, to flow toward the shroud 32 where boiling is generally less active. As a further result of the circulating flow produced by the effect, this solids bearing water will tend to flow downward along the inner periphery of the shroud 32. It should be noted, however, that this downward flow is not essential to the operation of the OTSG and will not exist within the central core area of the tube bundle 30.

The perforated blowdown pipe 60, when judiciously placed within the steam generator 10, is ideally suited to take advantage of the recirculating phenomenon engendered by the thermal syphon effect which may be present within the generator 10. Since the water situated in the blowdown pipe 60 will not boil due to the fact that the wall of the pipe prevents the water contained therein from coming into contact with the heat exchange tubes 18, the pipe will be filled with water up to the steam-water interface and be free of steam bubbles, thereby permitting a continuous downward flow in the pipe effectuated by the thermal syphon effect. This downward flow will channel the water having entrained solids from the interface down to the open lower end of the blowdown pipe where it is discharged near the blowdown and drain connection 68 (or 68A). This blowdown water will contain significantly greater amounts of soluble contaminants than the feed-water normally present in that zone. It should be appreciated that by virtue of the phenomenon just described, the concentration of solid contaminants will tend to be greater at the lower pipe end 66 of the blowdown pipe 60. By opening valve 70 and venting the accumulated solids concentrated about the lower pipe end 66 out through the blowdown and drain connection 68 (or 68A), the concentration of contaminants within the boiler water may be kept within acceptable levels.

As was already discussed, an OTSG may experience various water levels induced by changes in loading. This problem is overcome by equipping the blowdown pipe 60 with a plurality of perforations 62. The locations of the perforations 62 need not be fixed. Indeed, various perforation patterns may be spaced along a portion of the pipe. For example, a large number of perforations may be spaced along a portion of the pipe. On the other hand, a small number of perforations located at specified locations may be utilized. In addition, perforations of various diameters and angular orientations may be employed as well.

It was previously noted that OTSG's operated at high power levels do not require active blowdown systems. As a consequence, the blowdown pipe 60 should not be equipped with perforations 60 along its upper section. Of course, the line of demarcation between the perforated section and the nonperforated section may vary from one steam generator to another. It follows, however, that the blowdown pipe 60 should be sealed at its upper end 64 as well.

FIGS. 1 and 2 merely provide alternative orientations of the blowdown and drain connections 68 and 68A. FIG. 1 shows the blowdown and drain connection 68 disposed within the lower tube sheet 28 immediately below the blowdown pipe 60. In FIG. 2, the perforated blowdown ring 72 is shown disposed immediately above the bottom tube sheet 28 in close proximity to the blowdown pipe 60. Notice that in both embodiments the blowdown and drain connection 68 and the blowdown ring 72 are not connected to the blowdown pipe 60 but rather are oriented in close proximity thereof to effectuate the proper expulsion of the solid contaminants collecting above the lower tube sheet 28 due to the action of the blowdown pipe 60. Since the blowdown pipe 60 is not connected to the drain connection 68 or the ring 72, steam which may be drawn down to the bottom of the generator through the action of the blowdown pipe 60 is afforded the opportunity to bubble back to the surface of the boiler water rather than being expelled from the generator along with the blowdown fluid.

It is contemplated that one blowdown and drain connection be used per each blowdown pipe employed. Furthermore, any number of the blowdown pipe-blowdown and drain combinations may be used. However, for maximum performance, the combination should be disposed as far away as possible from any feedwater inlet location. As a consequence, the blowdown ring 72 should not be equipped with perforations along its entire annular surface. Rather, the perforations should be located in the immediate vicinity of the blowdown pipe 60. This orientation will allow for the expulsion of blowdown fluid while simultaneously preventing appreciable quantities of feed-water from escaping and thereby reducing the effectiveness of the blowdown system. The fact that the blowdown pipe 60 is not directly connected to the drain connection 68 (or 68A) permits this connection to function as a normal drain connection when blowdown is not desired.

The disclosed blowdown system may be successfully employed within alternate types of OTSG's as well. For example, there are OTSG's in use today (not shown) which do not have cylindrical shrouds defining a fluid flow passage. In such a design, the blowdown pipe should be disposed as close as possible to the interior surface defining the tube bank chamber. However, the underlying principles of operation (in conjunction with a suitably positioned blowdown and drain connection) would be the same in any case.

While in accordance with the provisions of the statutes there is illustrated and described herein a specific embodiment of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. In combination with a heat exchanger including an upright pressure vessel, upper and lower tube sheets disposed within the vessel and defining a tube bank chamber therebetween, a plurality of vertically oriented tubes extending through the tube bank chamber and supported by the tube sheets, means for directing a heated fluid through the tubes, means for directing a heat absorbing fluid around the tubes in indirect heat exchange with the heated fluid, blowdown means for expelling fluid having contaminants culled from the heat absorbing fluid, the blowdown means comprising at least one upright pipe perforated over at least a portion of its length, the pipe being disposed within the tube bank chamber and having a sealed upper end and an open lower end, and conduit means disposed in spaced adjacent relationship with the lower end of the pipe for discharging contaminant-laden fluid from said vessel.

2. The combination according to claim 1 wherein the upper and lower ends of the pipe are disposed in respective spaced adjacent relationship with the upper and lower tube sheets.

3. The combination according to claim 1 wherein the conduit means extends through the bottom tube sheet to the exterior of the vessel.

4. The combination according to claim 1 wherein the conduit means extends through the vessel wall.

5. The combination according to claim 1 including a perforated ring disposed immediately above the bottom tube sheet, the ring being flow-connected to said conduit means.

6. The combination according to claim 5 wherein the ring perforations are located within the immediate vicinity of the lower end of the pipe.

* * * * *